US008277023B2

(12) United States Patent
Kwon et al.

(10) Patent No.: US 8,277,023 B2
(45) Date of Patent: Oct. 2, 2012

(54) INKJET PRINTHEAD AND METHOD OF MANUFACTURING THE SAME

(75) Inventors: Myong-Jong Kwon, Suwon-si (KR); Sung-Joon Park, Suwon-si (KR); Jin-Wook Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 370 days.

(21) Appl. No.: 12/575,094

(22) Filed: Oct. 7, 2009

(65) Prior Publication Data

US 2010/0128091 A1 May 27, 2010

(30) Foreign Application Priority Data

Nov. 27, 2008 (KR) ..... 10-2008-0119008

(51) Int. Cl.
*B41J 2/14* (2006.01)
*B41J 2/05* (2006.01)

(52) U.S. Cl. ..... 347/47; 347/63

(58) Field of Classification Search ..... 347/47, 347/62, 64; 430/320
See application file for complete search history.

(56) References Cited

U.S. PATENT DOCUMENTS

| | | | | |
|---|---|---|---|---|
| 5,915,763 | A * | 6/1999 | Masuda | 29/890.1 |
| 6,986,980 | B2 * | 1/2006 | Kubota et al. | 430/156 |
| 2007/0256301 | A1 * | 11/2007 | Park et al. | 29/890.1 |
| 2008/0128386 | A1 * | 6/2008 | Yoon et al. | 216/27 |

* cited by examiner

*Primary Examiner* — Geoffrey Mruk
(74) *Attorney, Agent, or Firm* — Staas & Halsey LLP

(57) ABSTRACT

Disclosed are an inkjet printhead and a method of fabricating the same. The inkjet printhead can include a substrate; a chamber layer formed on the substrate and a nozzle layer formed on the chamber layer. The chamber layer defines one or more ink chambers in which ink to be ejected may be accommodated. The nozzle layer includes one or more nozzles through which the ink from the ink chambers are ejected. The nozzle layer may be formed of a cured product of a photosensitive dry film that includes an light absorption material.

7 Claims, 16 Drawing Sheets

INKJET PRINTHEAD AND METHOD OF MANUFACTURING THE SAME

CROSS-REFERENCE TO RELATED PATENT APPLICATION

This application claims the benefit of Korean Patent Application No. 10-2008-0119008, filed on Nov. 27, 2008, in the Korean Intellectual Property Office, the disclosure of which in its entirety is incorporated herein by reference.

TECHNICAL FIELD

The disclosure relates generally to a thermal inkjet printhead and a method of manufacturing the same.

BACKGROUND OF RELATED ART

Inkjet printers form an image, either monochromatic or in color, by discharging small droplets of ink from one or more inkjet printheads onto desired positions of a printing medium. Generally speaking, inkjet printers may be classified into two types, namely, a shuttle type inkjet printer and a line printing type inkjet printer. A shuttle type inkjet printer includes an inkjet printhead that reciprocates back and forth along a direction perpendicular to the moving direction of a printing medium in order to print an image on the printing medium. The line printing type inkjet printer, which has been developed with relatively higher printing speed in mind, on the other hand, includes a printhead or printheads that remains generally stationary, the collective length of which spans substantially the width of a printing medium so as to allow the stationary printhead(s) to print one or more lines of image across the width of the printing medium as the printing medium advances past the printhead unit.

A particular type of printhead, typically referred to as an "array type printhead," that includes a number of printheads arranged into an array may be used more often in a line printing type inkjet printer where the collective length of the array substantially covers the width of a piece of printing paper, for example, to further improve upon the printing speed and/or resolution. An array type printhead may also be employed in some shuttle type inkjet printers to improve the printing speed and/or the resolution, in which case, the array type printhead may have a collective length that is smaller than the width of the printing medium.

Inkjet printheads themselves may broadly be classified into one of two types according to the mechanism for the discharging of the ink droplets. The first of which two generally types is often referred to as a "thermal inkjet printhead," which generates bubbles in the ink with application of heat source, and which discharges the ink droplets by an expansive force of the resulting bubbles. The second type is referred to as a "piezoelectric inkjet printhead," which includes a piezoelectric material, and which discharges the ink droplets by a pressure applied to ink due to the deformation of the piezoelectric material.

The general discharging mechanism of ink droplets in the thermal inkjet printhead in relevant aspects may be as follows. When a pulse type current is allowed to flow through a heater typically formed of a resistive heating element, the resulting heat generated in the heater causes the ink adjacent to the heater to be rapidly heated to a high temperature, for example, to about 300° C. As a result, the ink starts to boil, generating ink bubbles, which as they expand applies pressure to the ink confined in an ink chamber. The pressure causes the ink in the vicinity of a nozzle to be discharged from the ink chamber in the form of droplets ejected through the nozzle.

By way of an example, referring to the schematic cross-sectional views of FIGS. 1 through 6B, a conventional method of manufacturing a known thermal inkjet printhead will be briefly described. In these drawings and as well as in the associated descriptions below, for the sake of brevity, only one ink chamber structure is depicted and described. However, it should be understood and well known to those skilled in the art that an inkjet printhead may include a large number of ink chambers and the associated nozzles.

Referring to FIG. 1, a chamber layer 12 may be formed on a substrate 10. The chamber layer 12 defines the ink chamber in which the ink to be discharge is filled, and may be formed by coating a chamber layer material on the substrate 10 to a predetermined thickness and by patterning the coated chamber layer material. Referring to FIG. 2, a sacrificial layer 15 may subsequently be formed on the substrate 10 and the chamber layer 12 so as to fill the ink chamber formed in the chamber layer 12. The sacrificial layer 15 may be formed by coating a sacrificial layer material on the substrate 10 and the chamber layer 12 to a predetermined thickness. Referring to FIG. 3, the sacrificial layer 15 and/or the chamber layer 12 may be planarized using, e.g., chemical mechanical polishing (CMP). Referring to FIG. 4, a nozzle layer 16 that includes a nozzle 17 may be formed on the planarized chamber layer 12 and sacrificial layer 15. More specifically, the chamber layer 12 and the sacrificial layer 15 a may be coated with a nozzle layer material of a predetermined thickness, which is then patterned using photolithography so as to form the nozzle 17, to thereby complete the formation of the nozzle layer 16. Then, the sacrificial layer 15 is removed using a solvent to form the ink chamber 13 in the chamber layer 12 as illustrated in FIG. 5. Referring to FIGS. 6A and 6B, the substrate 10 may then be etched to form an ink feedhole 11 through which ink is supplied to the ink chamber 13. With the formation of the feed hole 11, the process of the manufacture of the inkjet printhead may substantially be complete. FIGS. 6A and 6B are cross-sectional views of the completed inkjet printhead cut in directions perpendicular to each other.

In the above described conventional method of manufacturing, and in the resulting conventional thermal inkjet printhead, the thickness of the chamber layer 12 may be determined only by the CMP process. However, it can be difficult to obtain a uniform thickness of the chamber layer 12 by a typical CMP process, and attempts to improve upon the uniformity may come at an added manufacturing costs. moreover, the coating and the removal of the sacrificial layer 15 may add unnecessary complication to the manufacturing process, and may adversely impact the yield.

Another conventional method of manufacturing of a thermal inkjet printhead and the resulting conventional thermal inkjet printhead are illustrated in reference to FIGS. 7 through 9B. Again, for brevity, only one ink chamber and only one nozzle are depicted and described.

Referring to FIG. 7, a chamber layer 22 may be formed on a substrate 20. The chamber layer 22 defines an ink chamber in which ink to be discharged is filled. An ink feed hole for supplying ink to the ink chamber is formed in the substrate 20 as described earlier. The chamber layer 22 may be formed by laminating a first photosensitive dry film on the substrate 20, and by patterning the stacked first photosensitive dry film. The chamber layer 22 may alternatively be formed by coating a liquid or wet resist on the substrate 20. Referring to FIG. 8, a second photosensitive dry film 26' is stacked on the chamber layer 22 using lamination. Then, referring to FIGS. 9A and 9B, the second photosensitive dry film 26' is patterned using photolithography to form a nozzle 27, thus forming a nozzle layer 26 on the chamber layer 22. FIGS. 9A and 9B are cross-sectional views of a completed inkjet printhead cut in directions perpendicular to each other.

The method illustrated in FIGS. 7 through 9B may be an improvement upon the method depicted in FIGS. 1 through 6B in so far as it utilizes photosensitive films to form the chamber layer 22 and the nozzle layer 26, and may thus allow better control of the thicknesses of the chamber layer 22 and the nozzle layer 26 and/or simpler overall manufacturing process. However, further improvements upon the above described conventional fabrications processes of thermal inkjet printhead may be desirable.

SUMMARY OF THE DISCLOSURE

According to an aspect of the disclosure, an inkjet printhead may be provided to include a substrate; a chamber layer formed on the substrate and a nozzle layer formed on the chamber layer. The chamber layer may define an ink chamber. The nozzle layer may have formed therein a nozzle that is in fluid communication with the ink chamber. The nozzle layer may be formed of a cured product of a photosensitive dry film that includes a light absorption material.

The light absorption material may include but is not limited to at least one compound selected from a benzophenone compound, a salicylic acid compound, a phenyl acrylate compound, a benzotriazole compound, an azo dye, a coumarine compound, a thioxanthone compound, a stilbene compound and a naphthalic acid compound.

The photosensitive dry film may include prepolymer, 1 to 10 parts by weight based on 100 parts by weight of the prepolymer of a photoinitiator and 0.03 to 5 parts by weight based on 100 parts by weight of the prepolymer of the light absorption material:

The chamber layer may comprise one of a cured product of a photosensitive polymer composition and a cured product of a photosensitive dry film.

The substrate may include an ink feed hole in fluid communication with the ink chamber.

The inkjet printhead may further include an insulating layer formed on the substrate; a heater and an electrode sequentially formed on the insulating layer; and a passivation layer formed to cover the heater and the electrode.

The inkjet printhead may further include an anti-cavitation layer formed on the passivation layer.

The inkjet printhead may further include a glue layer interposed between the substrate and the chamber layer.

According to another aspect of the disclosure, there is provided a method of manufacturing an inkjet printhead. The method may include: forming a chamber layer on a substrate; and forming a nozzle layer on the chamber layer. The chamber layer may define a chamber in which to accommodate ink. The nozzle layer may have a nozzle in fluid communication with the chamber. The nozzle layer may comprise a cured product of a photosensitive dry film that includes a light absorption material.

The chamber layer may be formed by depositing a chamber material layer composed of one of a photosensitive polymer composition and a photosensitive dry film on the substrate, and by patterning the chamber material layer to form the chamber.

The nozzle layer may be formed by forming a nozzle material layer of a photosensitive dry film on the chamber layer, and by patterning the nozzle material layer.

The method may further include forming an ink feed hole in the substrate before forming of the chamber layer.

The method may further include forming an ink feed hole in the substrate after forming of the chamber layer and prior to forming of the nozzle layer.

The method may further include forming an ink feed hole in the substrate after forming of the nozzle layer.

The method may further include, before forming of the chamber layer on the substrate: forming an insulating layer on the substrate; forming a heater and an electrode sequentially on the insulating layer; and forming a passivation layer to cover the heater and the electrode.

The method may further include forming an anti-cavitation layer on the passivation layer.

The photosensitive dry film may be fabricated by a filming process in which the solvent is removed from a photosensitive polymer composition, wherein the photosensitive polymer composition comprises. a prepolymer; 1 to 10 parts by weight based on 100 parts by weight of the prepolymer of a photoinitiator; 0.03 to 5 parts by weight based on 100 parts by weight of the prepolymer of the light absorption material; and 30 to 300 parts by weight based on 100 parts by weight of the prepolymer of a solvent.

The cured product of the photosensitive dry film may comprise a prepolymer, 1 to 10 parts by weight based on 100 parts by weight of the prepolymer of a photoinitiator and 0.03 to 5 parts by weight based on 100 parts by weight of the prepolymer of the light absorption material.

The prepolymer may comprise at least one selected from a glycidyl ether functional group, ring-opened glycidyl ether functional group, oxytein functional group on a repeat monomer unit, a phenol novolak resin based backbone, a bisphenol A based backbone, a bisphenol F based backbone and an alicyclic based backbone.

The light absorption material may comprise at least one compound selected from a benzophenone compound, a salicylic acid compound; a phenyl acrylate compound, a benzotriazole compound, an azo dye, a coumarine compound, a thioxanthone compound and a naphthalic acid compound.

BRIEF DESCRIPTION OF THE DRAWINGS

Various features and advantages of the disclosure will become more apparent by the descriptions herein of several embodiments thereof with reference to the attached drawings, in which.

DETAILED DESCRIPTION OF THE DISCLOSURE

Figure 1:
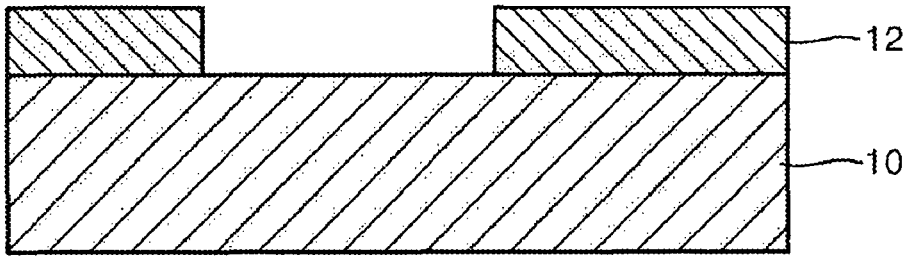
FIG. 1 PRIOR ART
FIGS. 1 through 6B are cross-sectional views schematically illustrating a conventional thermal inkjet printhead and a conventional method of manufacturing of the same.
Figure 2:
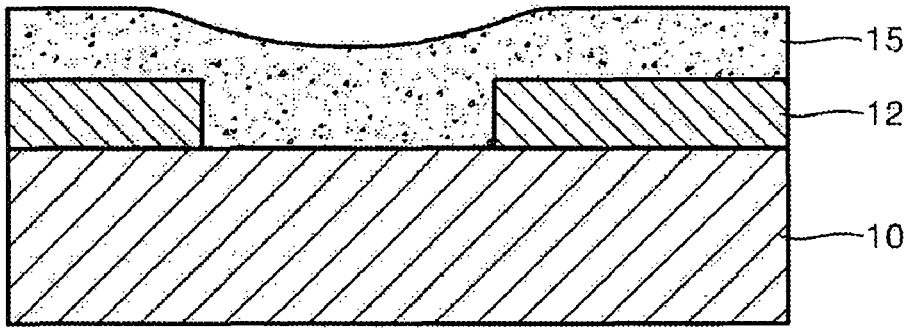
FIG. 2 PRIOR ART
Figure 3:
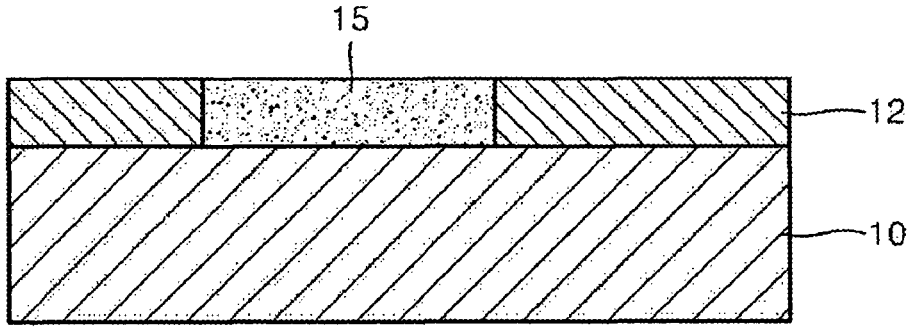
FIG. 3 PRIOR ART
Figure 4:
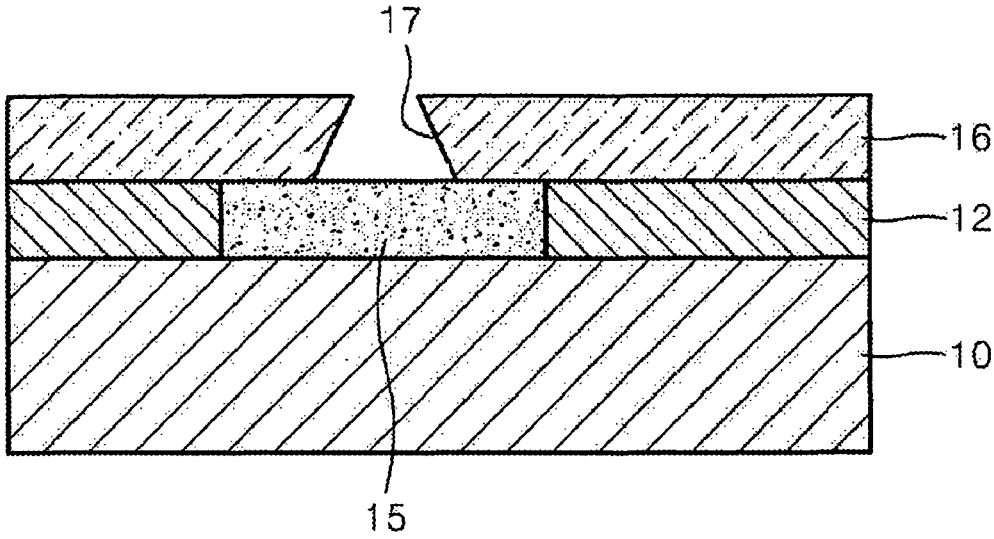
FIG. 4 PRIOR ART
Figure 5:
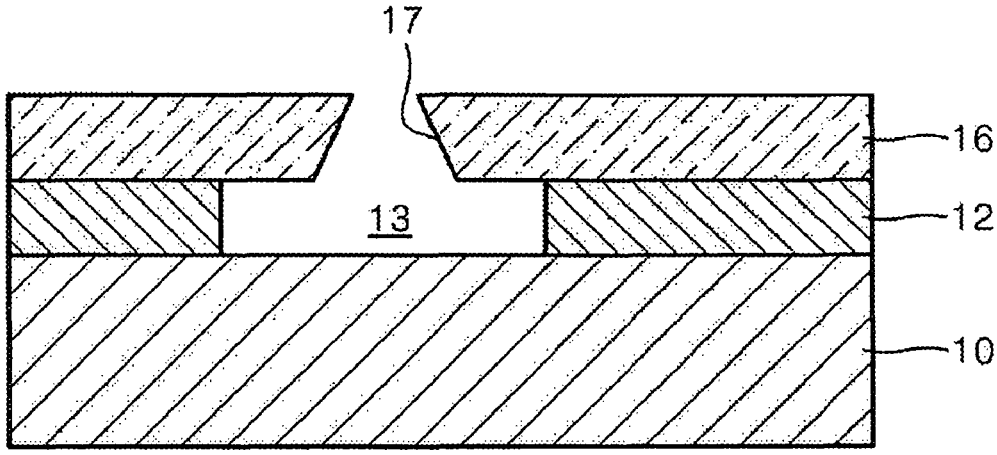
FIG. 5 PRIOR ART
Figure 6A:
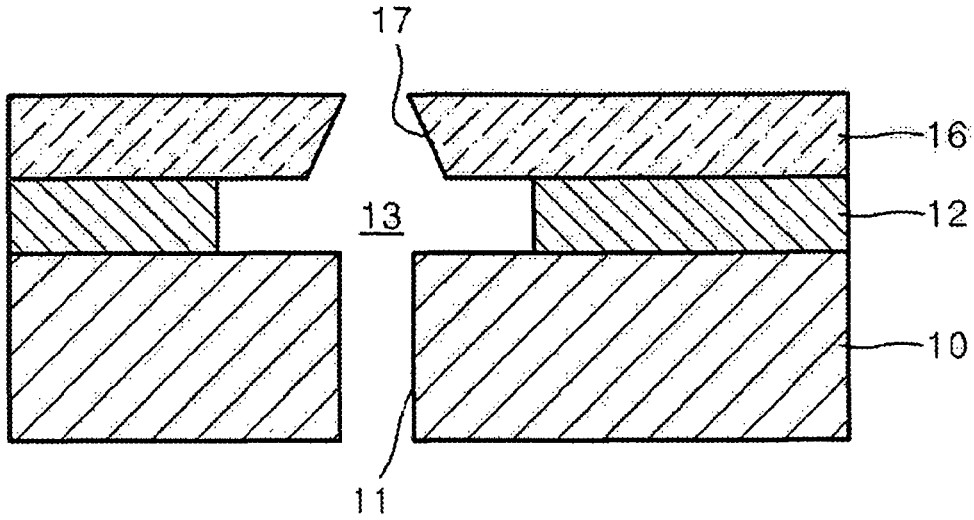
FIG. 6A PRIOR ART
Figure 6B:
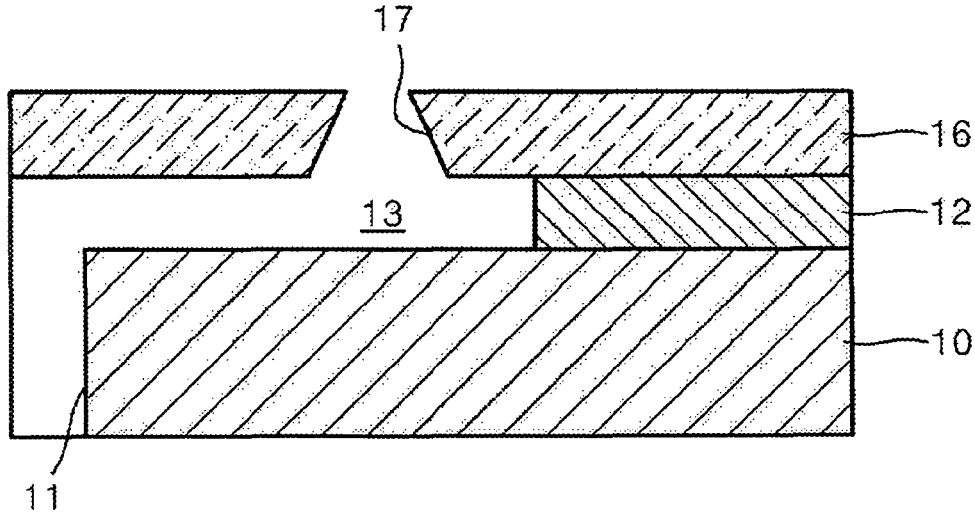
FIG. 6B PRIOR ART
Figure 7:
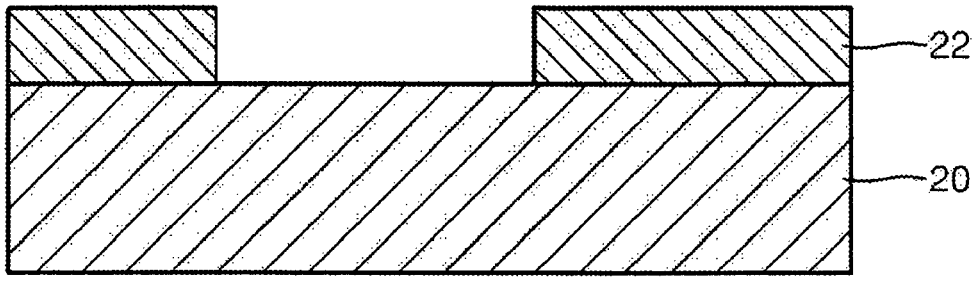
FIG. 7 PRIOR ART
FIGS. 7 through 9B are cross-sectional views schematically illustrating another conventional method of manufacturing a conventional thermal inkjet printhead.
Figure 8:
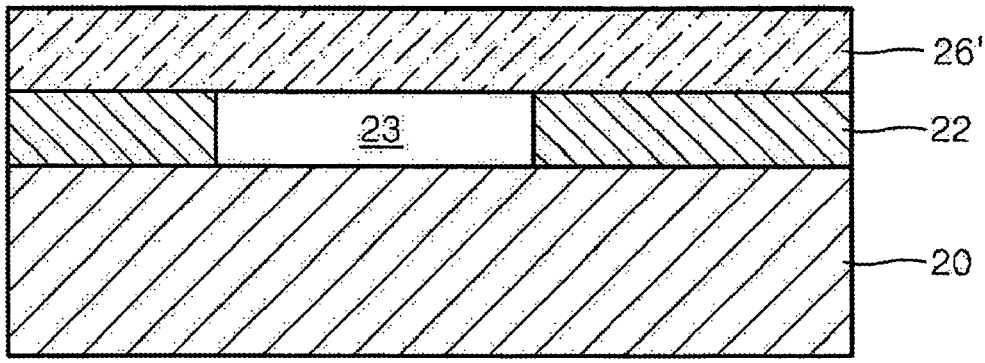
FIG. 8 PRIOR ART
Figure 9A:
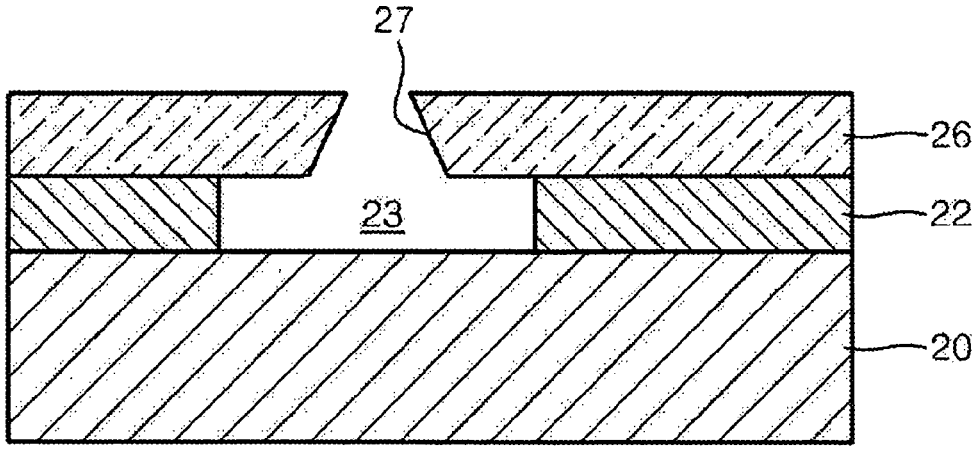
FIG. 9A PRIOR ART
Figure 9B:
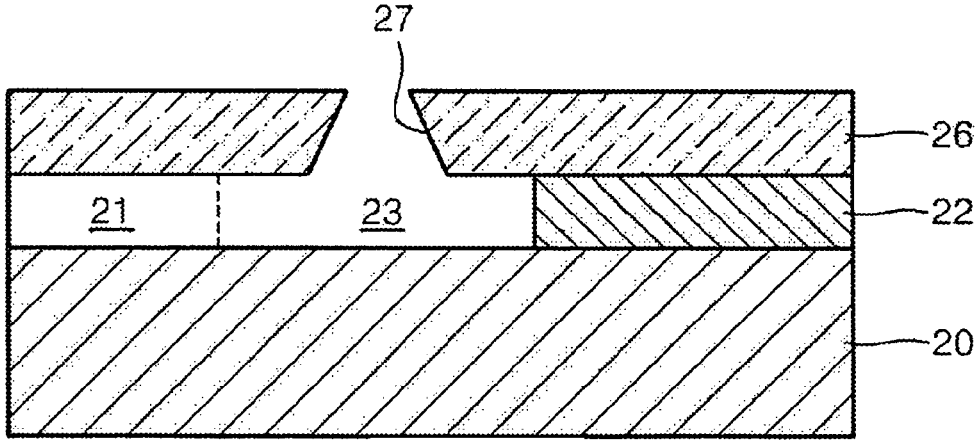
FIG. 9B PRIOR ART

The disclosure will now be described more fully with reference to the accompanying drawings, in which several embodiments are shown. In the drawings, dimensions, such as, for example, the thicknesses of layers and regions may not be to true scale, and may be exaggerated for clarity. Like reference numerals in the drawings denote like elements. It will be understood that when a layer is referred to as being "formed on" another layer, it can be directly or indirectly formed on the other layer. That is, for example, intervening layers may be present.

Figure 10:
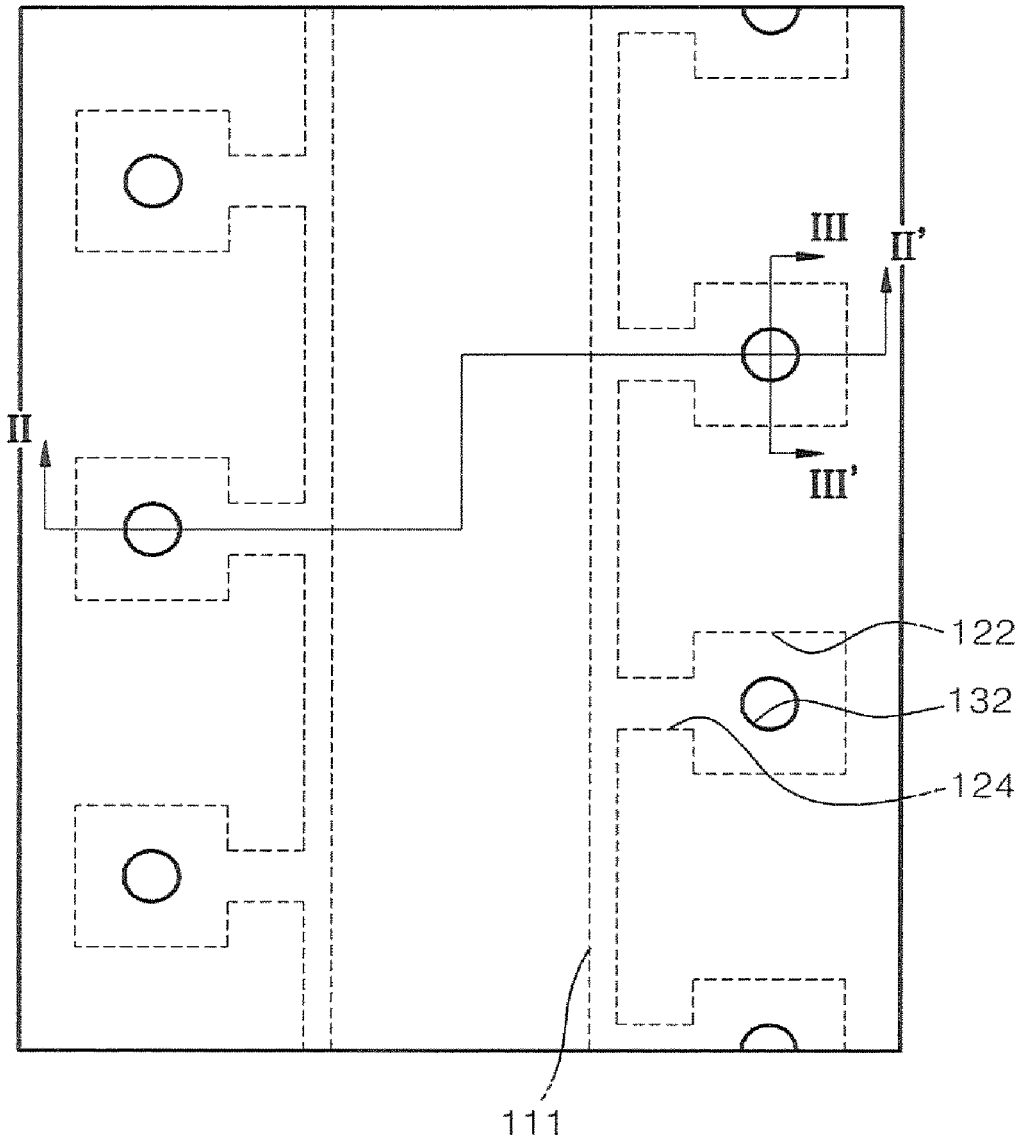
FIG. 10 is a plan view of an inkjet printhead according to an embodiment of the present disclosure.
Figure 11:
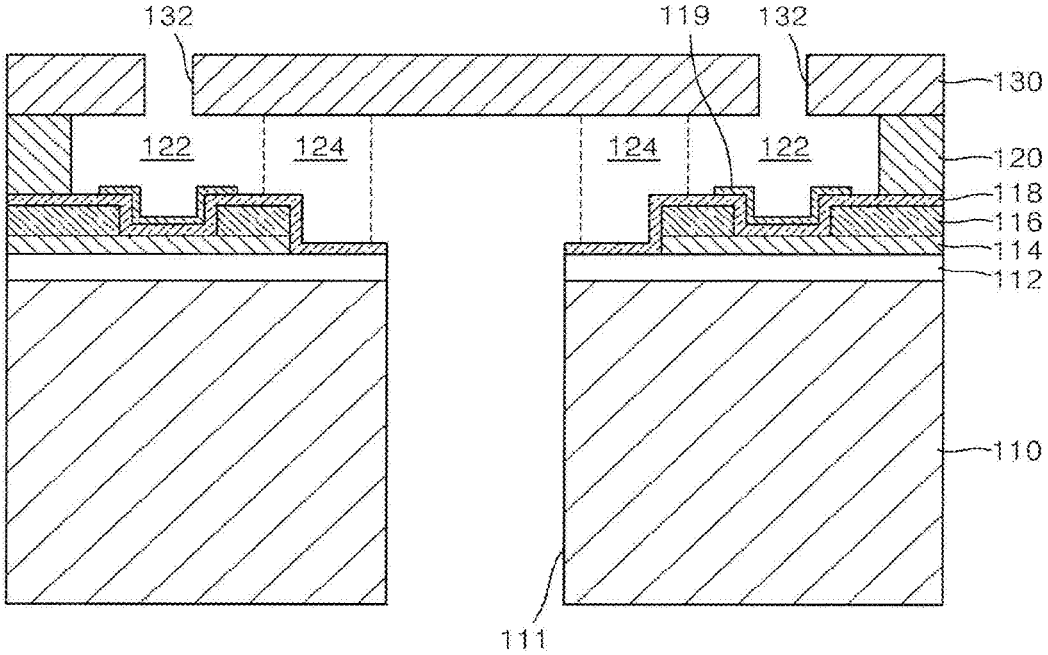
FIG. 11 is a cross-sectional view of the inkjet printhead of FIG. 10 cut along the line II-II' of FIG. 10.
Figure 12:
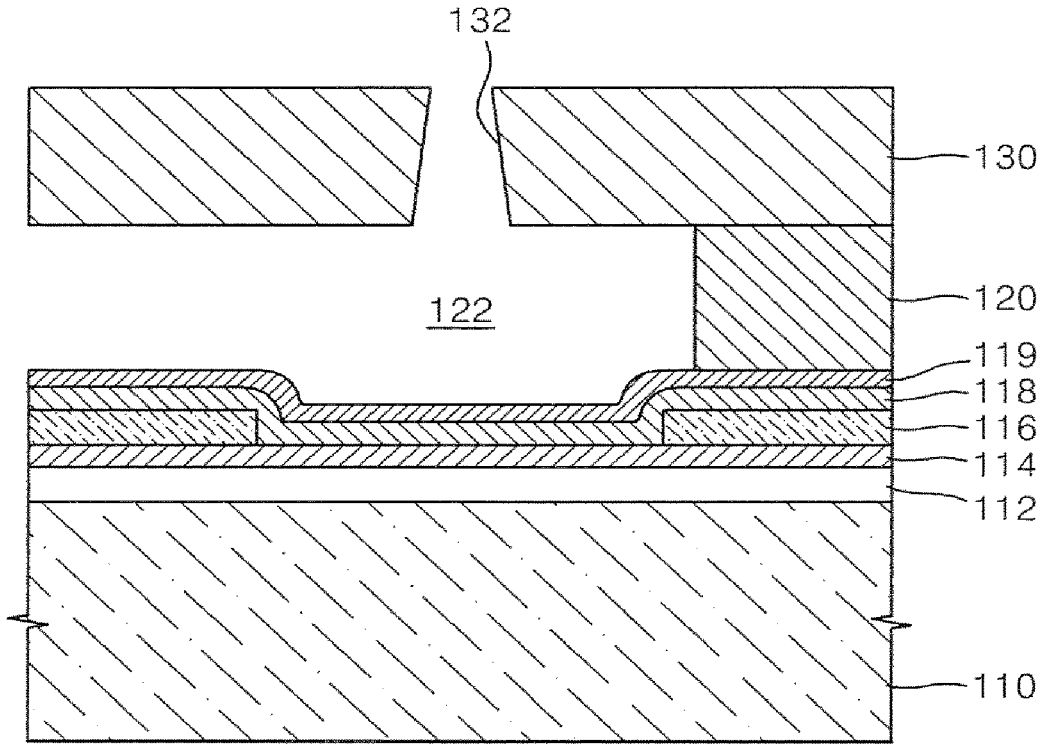
FIG. 12 is a cross-sectional view of the inkjet printhead of FIG. 10 cut along the line III-III' of FIG. 10.

FIG. 10 is a plan view of an inkjet printhead according to an embodiment of the disclosure. FIG. 11 is a cross-sectional view of the inkjet printhead of FIG. 10 cut along the line II-II' of FIG. 10. FIG. 12 is a cross-sectional view of the inkjet printhead of FIG. 10 cut along the line III-III' of FIG. 10.

Referring to FIGS. 10 through 12, according to an embodiment, a chamber layer 120 and a nozzle layer 130 may sequentially be formed on a substrate 110, which itself may have formed thereon a plurality of material layers. The substrate 110 may be formed of, for example, silicon. The substrate 110 may include an ink feed hole 111 penetrating therethrough for supplying ink. An ink chamber 122 is formed in the chamber layer 120, and may be filled with ink supplied from the ink feed hole 111. A nozzle 132, through which ink is to be discharged, may be formed in the nozzle layer 130.

An insulating layer 112 for insulating the heat between the substrate 110 and a heater 114 may be formed on the substrate 110. To that end, the insulating layer 112 may be formed of thermally insulating material such as, for example, silicon oxide. The heater 114 for heating the ink in the ink chamber 122 and for thereby generating the ink bubbles may be formed on the insulating layer 112. The heater 114 may be formed adjacent the bottom surface of the ink chamber 122. The heater 114 may be formed of a heating resistive material such as, for example, a tantalum-aluminum alloy, a tantalum nitride, a titanium nitride, tungsten silicide or the like. However, it should be noted that the above list of material is provided only by way of non-limiting examples, and that other materials can also be used to form the heater 114.

An electrode or electrodes 116 may be formed on the heater 114. The electrode(s) 116 may supply current to the heater 114, and may be formed of a material having sufficient electrical conductivity. The electrode 116 may be formed of, for example, aluminum (Al), an Al alloy, gold (Au), silver (Ag), or the like. However, the electrode 116 may be formed of materials other than the above listed examples.

A passivation layer 118 may be formed on the heater 114 and the electrode 116. The passivation layer 118 may prevent the heater 114 and the electrode 116 from coming in contact with the ink, and thus may protect the same from oxidizing or corroding. The passivation layer 118 may be formed of, for example, without limitation, a silicon nitride, a silicon oxide, or the like. An anti-cavitation layer 119 may be formed on at least a portion of the passivation layer 118 disposed above the heater 114. The anti-cavitation layer 119 may protect the heater 114 from being damaged by a cavitation force generated when the ink bubbles burst, and may be formed of, for example, without limitation; tantalum Ta. Although not illustrated in the drawings, a glue layer may be further formed on the passivation layer 118 in order to promote adhesion between the chamber layer 120 to the passivation layer 118.

The chamber layer 120 is stacked on the passivation layer 118. A plurality of ink chambers 122, in each of which ink supplied from the ink feed hole 111 is to be filled, may be formed in the chamber layer 120. While in FIG. 11, two ink chambers 122 are depicted, there may be, and usually are, a large number of ink chambers 122 defined in the chamber layer 120. The ink chambers 122 may be disposed along a longitudinal direction of the ink feed hole 111 on both sides of the ink feed hole 111. Further, a plurality of restrictors 124, which define the ink flow paths between the ink feed hole 111 and the respective ink chambers 122, may also be formed in the chamber layer 120. The chamber layer 120 may be formed of, for example, but not necessarily limited to, a cured product of a photosensitive polymer composition or a cured product of a photosensitive dry film. According to an embodiment, for example, the chamber layer 120 may be formed by forming a chamber material layer, formed of a photosensitive polymer composition or a photosensitive dry film, on the substrate 110, and by patterning the chamber material layer.

The nozzle layer 130 may be formed on the chamber layer 120. A through hole 152 (shown in FIG. 12) connecting the nozzle 132 with the ink chamber 122 may be formed in the nozzle layer 130. The nozzle 132, through which ink is discharged, may be formed in the nozzle layer 130. According to aspects of the present disclosure, the nozzle layer 130 may be formed of, for example, a cured product of a photosensitive dry film that includes an light absorption material. In particular, according to an embodiment, the nozzle layer 130 may be formed by forming a nozzle material layer, formed of the photosensitive dry film, on the chamber layer 120, and by patterning the nozzle material layer.

The photosensitive polymer composition for forming the photosensitive dry film may include a prepolymer, a photoinitiator and a solvent, and may further include additional additives. The photosensitive polymer composition is not limited to the above listed examples, and may include other materials. The photosensitive dry film may be fabricated by a filming process in which the solvent is removed from the photosensitive polymer composition.

The prepolymer may be formed of, for example, an epoxy based material. However, the material for the prepolymer is not limited the above. In general, any material for forming a chamber layer or a nozzle layer of an inkjet printhead may be used as the prepolymer.

For example, a prepolymer having a glycidyl ether functional group, ring-opened glycidyl ether functional group, or oxytein functional group on a repeat monomer unit, as well as a phenol novolak resin based backbone, a bisphenol A based backbone, a bisphenol F based backbone or an alicyclic based backbone, may be used.

The prepolymer may be exposed to actinic rays, thereby forming a cross linked polymer.

The prepolymer may be formed of, for example, a backbone monomer selected from phenol, o-cresol, ρ-cresol, bisphenol A, an alicyclic compound and mixtures thereof.

Examples of a prepolymer having the glycidyl ether functional group may include, but are not limited to, a difunctional glycidyl ether functional group and a multifunctional glycidyl ether functional group, as illustrated below.

The prepolymer having the difunctional glycidyl ether functional group may be a compound represented by Formula 1.

Formula 1

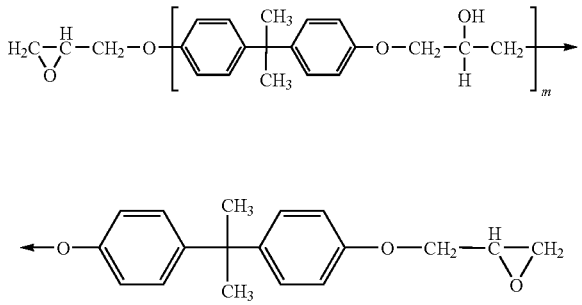

wherein m is a positive number in the range of 1 to 20.

The prepolymer having the difunctional glycidyl ether functional group may form a film with low crosslinking density.

Types of the prepolymer having the difunctional glycidyl ether functional group may include, but are not limited to, EPON 828, EPON 1004, EPON 1001F, or EPON 1010 manufactured by Shell Chemical Co., Ltd., DER-332, DER-331, or DER-164 manufactured by Dow Chemical Co., Ltd., and ERL-4201 or ERL-4289 manufactured by Union Carbide Co., Ltd.

Types of the prepolymer having the multifunctional glycidyl ether functional group may include, but are not limited to, EPON SU-8 or EPON DPS-164 manufactured by Shell Chemical Co., Ltd., DEN-431 or DEN-439 manufactured by Dow Chemical Co., Ltd., and EHPE-3150 manufactured by Daicel Chemical Co., Ltd.

Examples of the prepolymer having the glycidyl ether functional group on a repeat monomer unit and a phenol novolak resin based backbone may include a compound represented by Formula 2.

Formula 2

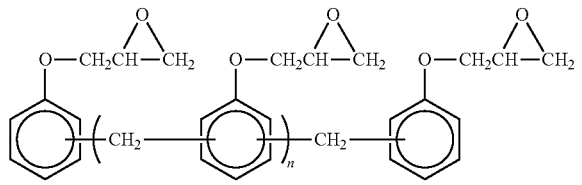

wherein n may be, for example, in the range of about 1 to about 20, and may preferably be in the range of 1 to 10.

In addition, examples of the prepolymer having the glycidyl ether functional group on a repeat monomer unit and a phenol novolak resin based backbone may include compounds using o-cresol and ρ-cresol, instead of phenol, represented by Formulas 3 and 4.

Formula 3

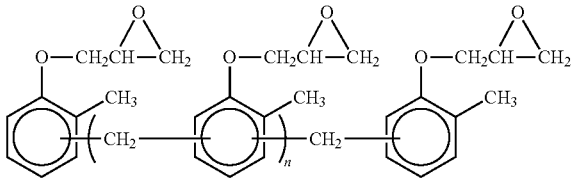

Formula 4

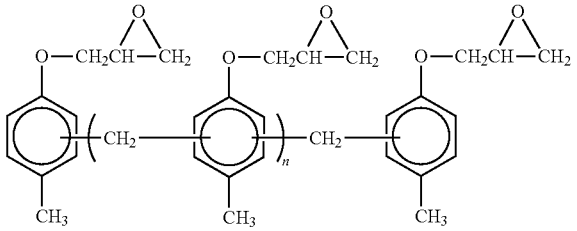

wherein n may be, for example, in the range of about 1 to about 20, and may preferably be in the range of 1 to 10.

Moreover, examples of the prepolymer having the glycidyl ether functional group on a repeat monomer unit and a bisphenol A may include compounds represented by Formulas 5 and 6.

Formula 5

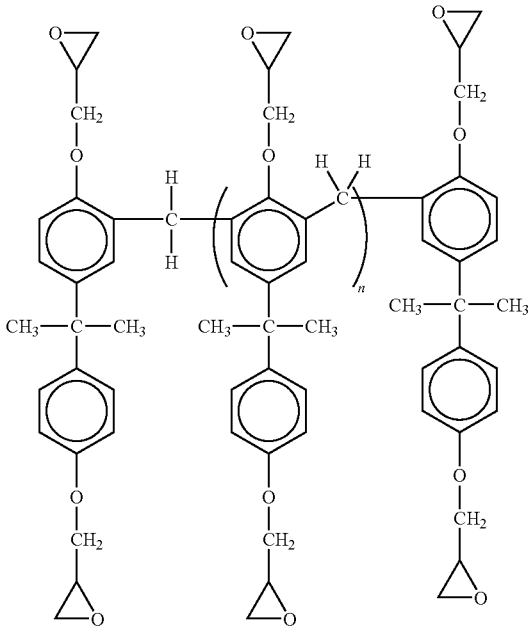

-continued

Formula 6

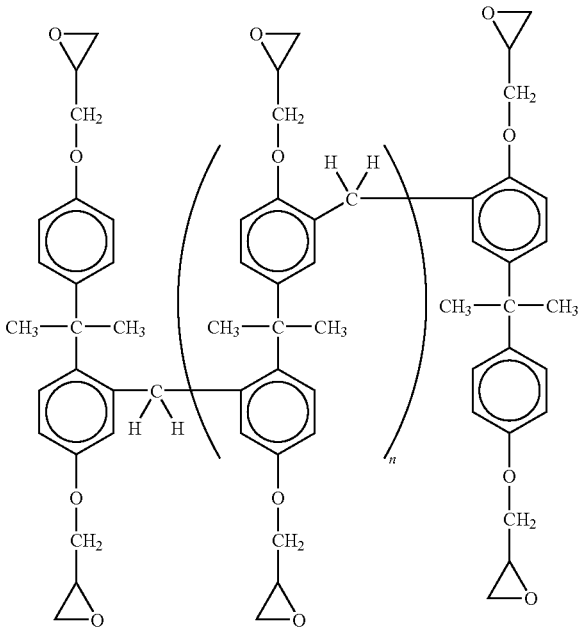

wherein n may be, for example, in the range of about 1 to about 20, and may preferably be in the range of 1 to 10.

The prepolymer having the glycidyl ether functional group on a repeat monomer unit and an alicyclic based backbone may be resented by Formula 7, and may include addition products of 1,2-epoxy-4(2-oxiranyl)-cyclohexane of 2,2-bis (hydroxy methyl)-1-butanol which can be purchased as EHPH-3150 from Daicel Chemical Co., Ltd.

Formula 7

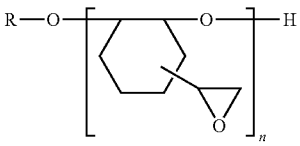

wherein n may be, for example, in the range of about 1 to about 20, and may preferably be in the range of 1 to 10.

The prepolymer having the glycidyl ether functional group on a repeat monomer unit and a bisphenol F based backbone may be represented by Formula 8.

Formula 8

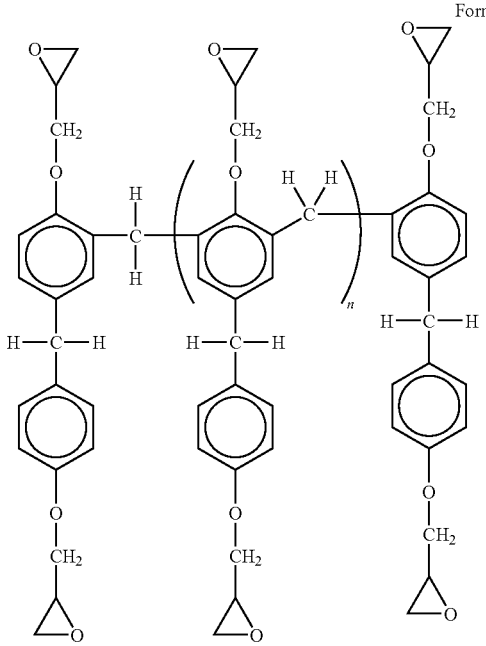

wherein n may be, for example, in the range of about 1 to about 20, and may preferably be in the range of 1 to 10.

The prepolymer having an oxytein functional group on a repeat monomer unit and a bisphenol A based backbone may be represented by Formula 9.

Formula 9

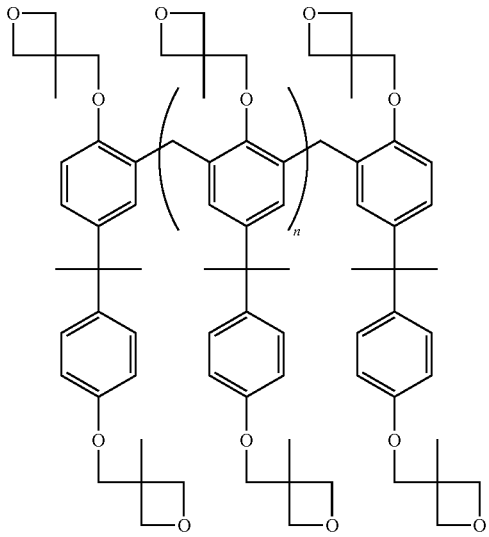

wherein n may be, for example, in the range of about 1 to about 20, and may preferably in the range of 1 to 10.

The prepolymer according to an embodiment of the present disclosure may include at least one of the compounds represented by Formulas 1 through 9.

The photoinitiator may generate ion or free radical which generally initiates polymerization during exposing. Examples of the photoinitiator may include aromatic group halonium salts and sulfonium salts of VA group and Vi group elements, and may be, for example, UVI-6974 obtained from Union Carbide Co., Ltd., SP-172 obtained from Asahi denka Co., Ltd., or Cyracure 6974 obtained from Dow Chemical Co., Ltd.

Examples of the aromatic group sulfonium salts may include triphenyl sulfonium tetrafluoroborate, triphenylsulfonium hexafluoroantimonate (UVI-6974), phenylmethylbenzylsulfonium hexafluoroantimonate, phenylmethylbenzylsulfonium hexafluorophosphate, triphenylsulfonium hexafluorophosphate, methyldiphenyl sulfonium tetrafluoroborate, and dimethyl phenylsulfonium hexafluorophosphate.

As the aromatic group halonium salts, an aromatic group iodonium salt may be used. Examples of the aromatic group iodonium salt may include, but are not limited to, diphenyliodonium tetrafluoroborate, diphenyliodonium hexafluoroantimonate, and butylphenyliodonium hexafluoroantimonate (SP-172).

The amount of photoinitiator may be 1 to 10 parts by weight based on 100 parts by weight of the prepolymer, for example, 1.5 to 5 parts by weight. When the amount of photoinitiator is below 1 part by weight, enough crosslinking reaction may not be obtained. When the amount of photoinitiator is above 10 parts by weight, optical energy that is greater than optical energy corresponding to an appropriate thickness may be needed, thereby decreasing crosslinking speed.

The solvent may include, for example, at least one solvent selected from gamma-butyrolactone, propylene glycol methyl ethyl acetate, tetrahydrofuran, methyl ethyl ketone, methyl isobutyl ketone, cyclopentanone, and xylene.

The amount of solvent may be 30 to 300 parts by weight based on 100 parts by weight of the prepolymer, for example, 50 to 200 parts by weight. When the amount of solvent is below 30 parts by weight, viscosity may gradually increase and thus workability may be declined. When the amount of solvent is above 300 parts by weight, viscosity of obtained polymer decreases and a pattern may not be sufficiently formed.

The photosensitive polymer composition according to an embodiment may further include a plasticizer as an additive. The plasticizer may be phthalates, trimellitic acid ester, or phosphoric acid ester. Examples of the phthalate plasticizer may include, but are not limited to, dioctyl phthalate (DOP) and diglycidyl hexahydro phthalate (DGHP). Examples of the trimellitic acid ester plasticizer may include, but are not limited to, tri-ethylhexyl trimellitate. Examples of the phosphoric acid ester plasticizer may include, but are not limited to, tricresyl phosphate. These plasticizers may be independently used or two or more plasticizers may be selected to be used in combination.

The amount of plasticizer may be 1 to 15 parts by weight based on 100 parts by weight of the prepolymer, for example 5 to 10 parts by weight. When the amount of plasticizer is below 1 part by weight, effect of the plasticizer may not be enough. When the amount of plasticizer is above 15 parts by weight, crosslinking density of the prepolymer may decrease.

As the additional additives, a photo-sensitizer, a silane coupling agent, a filler, and a viscosity modifier may be used. The photo-sensitizer may absorb light energy, facilitate energy transmission to other compounds, and form radicals or ion initiators. The photo-sensitizer may expand an energy wavelength range that is useful for exposing, and may typically be light absorbance chromophore of an aromatic group. Also, the photo-sensitizer may induce forming of radicals or ion initiators. Moreover, other additives may also be used.

As described above, the nozzle layer according to the present embodiment is formed of a cured product of a photosensitive dry film including a light absorption material. That is, according to an embodiment, comparing the nozzle layer with the chamber layer, the nozzle layer may be substantially the same as the chamber layer in so far as both are formed of the photosensitive dry film, the composition of which may basically include the prepolymer and the photoinitiator, and which may selectively include additional additives. However, according to an embodiment, the nozzle layer further includes the light absorption material.

The light absorption material absorbs light with a wavelength equal to a wavelength of the photoinitiator, and may not participate in the crosslinking reaction of the prepolymer. As a result, the light absorption material absorbs light reflected from the substrate when the nozzle material layer is exposed to form the nozzle layer so that crosslinking in an undesired region is prevented, and so that a uniform nozzle may be formed in a desired region.

A light absorption coefficient of the light absorption material may be, for example, 15 L/g·cm at or above 365 nm. The light absorption material may include, but is not limited to, at least one compound selected from a benzophenone compound, a salicylic acid compound, a phenyl acrylate compound, a benzotriazole compound, an azo dye, a coumarine compound, a thioxanthone compound, a stilbene compound and a naphthalic acid compound.

More specifically, the light absorption material may include, for example, but not limited to, at least one compound selected from a benzophenone compound such as 2,4-dihydroxybenzophenon or 2,2',4,4'-tetrahydroxybenzophenon; a salicylic acid compound such as phenyl salicylate or 4-t-butylphenyl salicylate; a phenyl acrylate compound such as ethyl-2-cyano-3,3-diphenylacrylate or 2-ethylhexyl-2-cyano-3,3-diphenylacrylate; a benzotriazole compound such as 2-(2-hydroxy-5-methylphenyl)-2H-benzotriazole or 2-(3-t-butyl-2-hydroxy-5-methylphenyl)-5-chloro-2H-benzotriazole; an azo dye such as Sudan Orange G; a coumarine compound such as 4-methyl-7-diethylamino-1-benzopyran-2-ones; a thioxanthone compound such as diethylthioxanthone; a stilbene compound; and a naphthalic acid compound.

The amount of light absorption material may be 0.03 to 5 parts by weight based on 100 parts by weight of the prepolymer, for example, 0.1 to 3 parts by weight. When the amount of light absorption material is below 0.03 parts by weight, effect of adding the light absorption material may not be realized. When the amount of light absorption material is above 5 parts by weight, an excessive amount of energy may be required to form a pattern or otherwise the pattern may not be sufficiently formed.

The type and amount of the light absorption material may vary according to the thickness of the nozzle layer and other characteristics.

Hereinafter, a method of manufacturing the inkjet printhead above is described.

The method of manufacturing the inkjet printhead according to an embodiment of the disclosure includes: forming a chamber layer on a substrate; and forming a nozzle layer having a nozzle on the chamber layer, wherein the nozzle layer is formed of a cured product of a photosensitive dry film including a light absorption material.

The chamber layer may be formed by forming a chamber material layer of a photosensitive polymer composition or a photosensitive dry film on the substrate, and by patterning the chamber material layer.

The nozzle layer may be formed by forming a nozzle material layer of a photosensitive dry film on the chamber layer, and by patterning the nozzle material layer.

An ink feed hole may be formed in the substrate. The ink feed hole may be formed before forming of the chamber layer, between forming of the chamber layer and forming of the nozzle layer, or after forming of the nozzle layer. The ink feed hole may be appropriately formed in consideration of whether to use the photosensitive polymer composition or the photosensitive dry film to form the chamber layer and other manufacturing processes.

FIGS. 13 through 20 are cross-sectional views illustrating the method of manufacturing the inkjet printhead according to an embodiment of the disclosure.

Figure 13:
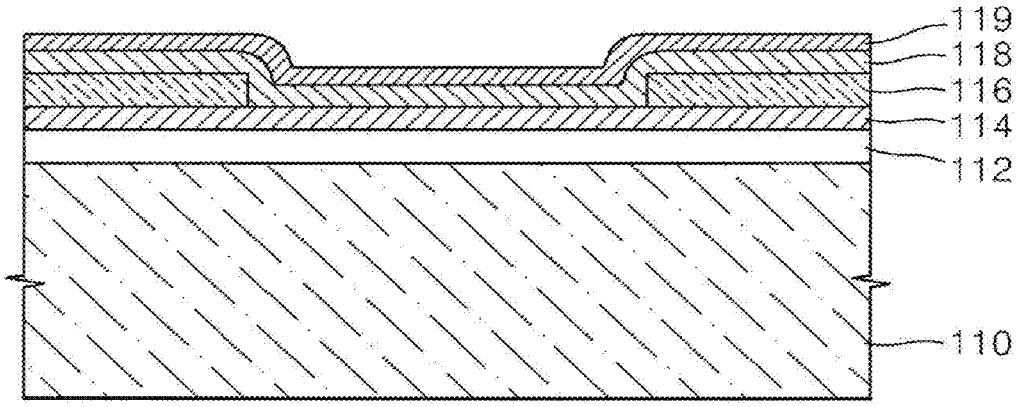
FIGS. 13 through 20 are cross-sectional views illustrating a method of manufacturing an inkjet printhead according to an embodiment of the present disclosure.

Referring to FIG. 13, the substrate 110 may be prepared, on which the insulating layer 112 may be formed. The substrate 110 may be formed of silicon. The insulating layer 112 is a layer for insulating the substrate 110 from the heater 114, and may be formed of for example, a silicon oxide. Then, the heater 114 for heating ink and generating bubbles may be formed on the insulating layer 112. The heater 114 may be formed by depositing a heating resistive material, for example, a tantalum-aluminum alloy, a tantalum nitride, a titanium nitride, tungsten silicide, or the like, on the insulating layer 112, and by patterning the deposited heating resistive material. Then, the electrode 116 for supplying current to the heater may be formed on the heater 114. The electrode 116 may be formed by depositing a metal having sufficient electrical conductivity, for example, aluminum (Al), an Al alloy, gold (Au), silver (Ag), or the like, on the heater 114, and by patterning the deposited metal.

The passivation layer 118 may be formed to cover the heater 114 and the electrode 116. The passivation layer 118 may prevent the heater 114 and the electrode 116 from oxidizing or corroding that may occur if allowed to come into contact with the ink, and may be formed of, for example, silicon nitride, silicon oxide, or the like. The anti-cavitation layer 119 may be formed on the passivation layer 118 disposed on the heater 114. The anti-cavitation layer 119 protects the heater 114 from a cavitation force generated when bubbles burst, and may be formed of, for example, tantalum Ta.

Figure 14:
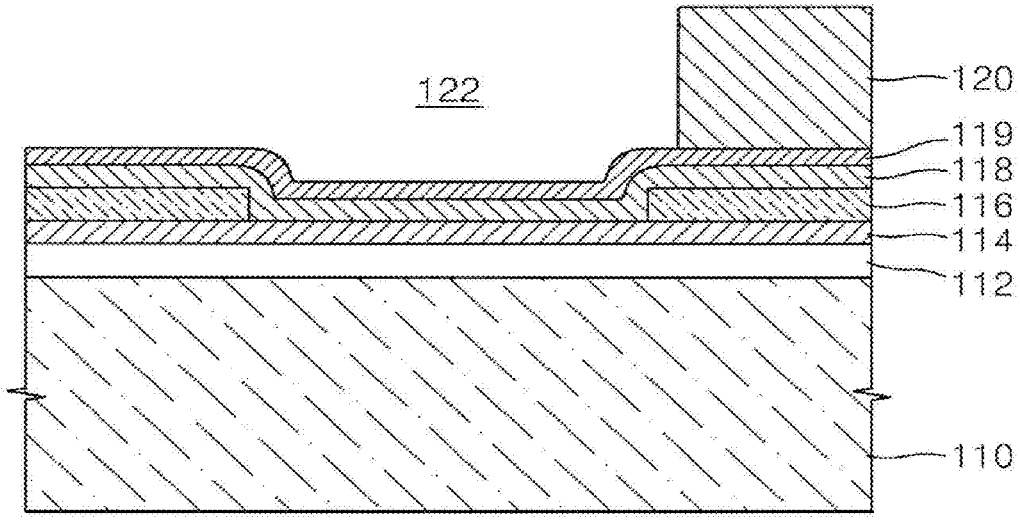

Referring to FIG. 14, the chamber layer 120 having the ink chamber 122 may be formed on the passivation layer 118. The chamber layer 120 may be formed by coating a chamber material layer (not illustrated) formed of a liquid photosensitive polymer or a photosensitive dry film on the passivation layer 118, and by patterning the coated chamber material layer. Accordingly, the ink chamber 122, which may be filled with ink to be discharged, is formed in the chamber layer 120. In addition, a plurality of restrictors 124 connecting the ink feed hole 111 with the ink chamber 122 may further be formed in the chamber layer 120. In addition, before forming of the chamber layer 120, a glue layer (not illustrated) may be further formed on the passivation layer 118 so that the chamber layer 120 may be properly adhere to the passivation layer 118. The glue layer may be formed of, for example, a photosensitive polymer.

Forming of the chamber layer 120 through patterning the chamber material layer and forming of the ink feed hole 111 on the substrate 110, on which the chamber layer 120 is formed, will be described in greater detail with reference to FIGS. 15 through 18.

Figure 15:
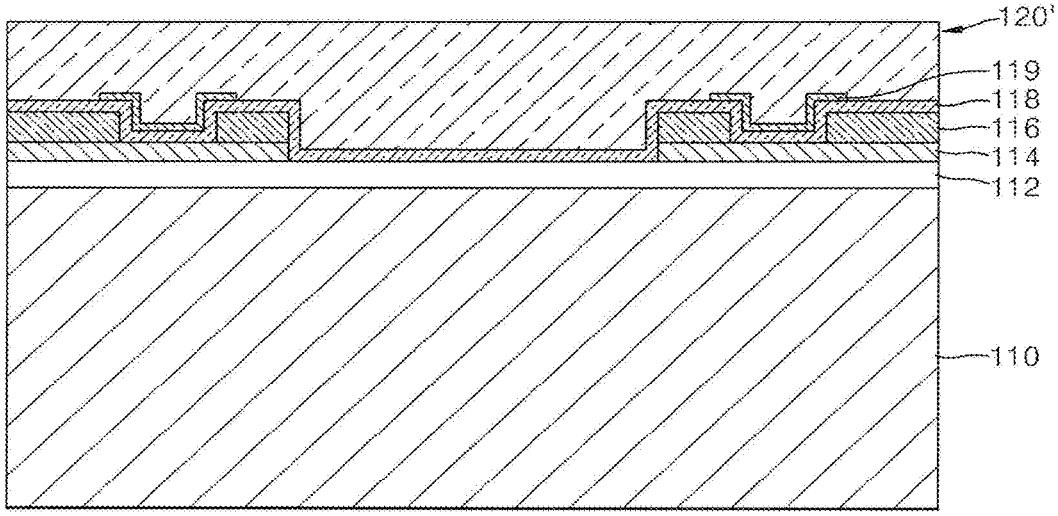

Referring to FIG. 15, a chamber material layer 120' is formed on the passivation layer 118 and/or the anti-cavitation layer 119. The chamber material layer 120' includes a photosensitive polymer composition. The chamber material layer 120' may be formed by laminating a dry film including a prepolymer and a photoinitiator on the passivation layer 118. The prepolymer included in the chamber material layer 120' may be a negative type photosensitive polymer.

An exposure process and a post exposure baking (PEB) process are performed with respect to the chamber material layer 120'. More specifically, the exposure process is performed using a photomask (not illustrated) on which patterns for the ink chamber(s) and/or the restrictor(s) are drawn.

Figure 16:
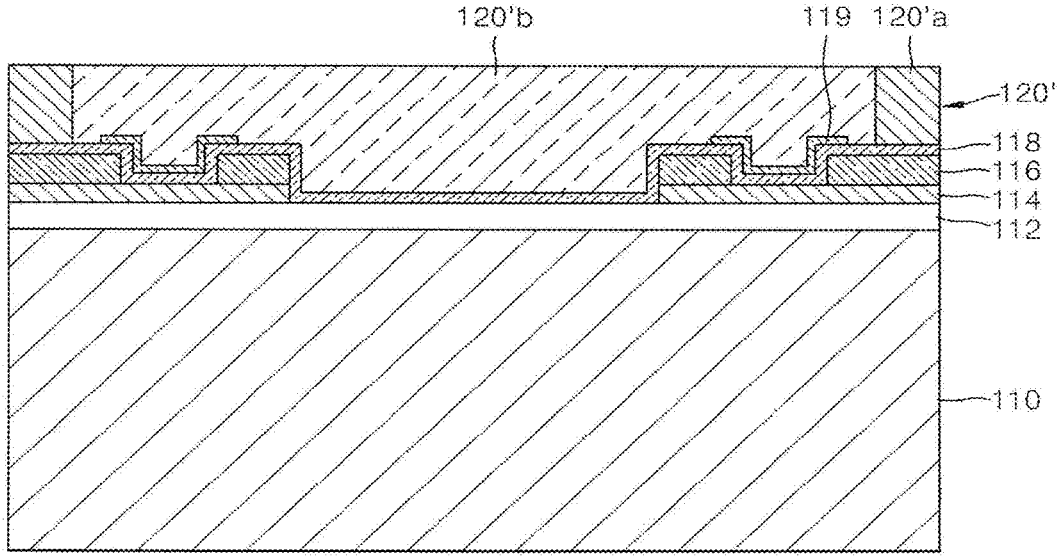
Figure 17:
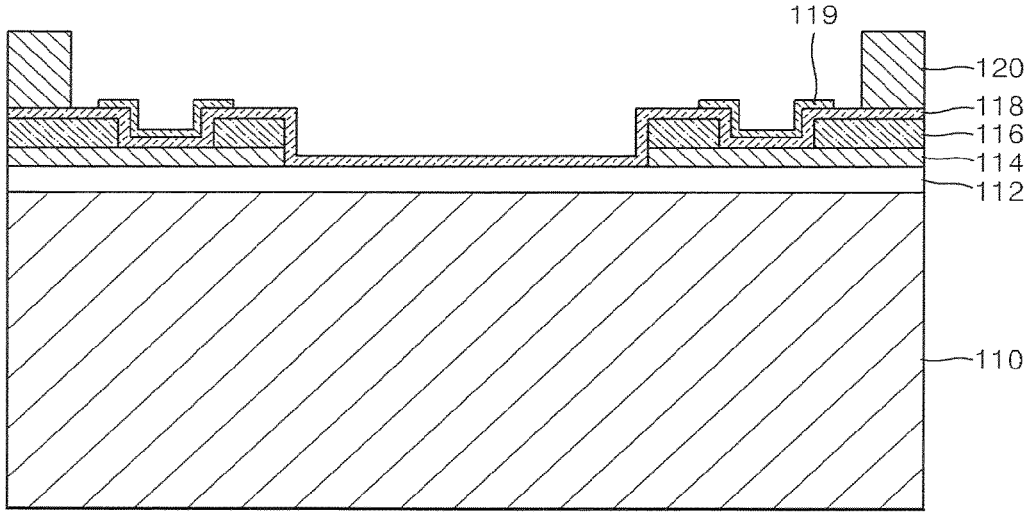

Referring to FIGS. 16 and 17, ions or free radicals initiating polymerization by the photoinitiator are generated in an exposed portion 120' a of the chamber material layer 120' due to the exposure process.

Then, the PEB process is performed with respect to the chamber material layer 120'. The PEB process may be performed at, for example, about 90 to 120° C. for about 3 to 5 minutes. Due to the PEB process, cross-linking of the prepolymer occurs in the exposed portion 120' a of the chamber material layer 120', thereby forming a crosslinked product.

A developing process is performed with respect to the chamber material layer 120', to which the exposure process and the PEB process had been performed to form the chamber layer 120. Due to the developing process, a non-exposed portion **120*b*' of the chamber material layer 120' is removed by the developer. The photosensitive polymer composition included in the exposed portion 120' a of the chamber material layer 120' has a cross-linked structure through the PEB process so that the exposed portion 120' a of the chamber material layer 120' is not removed by the developing process, thus resulting in the formation of the chamber layer 120 as shown in FIG. 17**.

Figure 18:
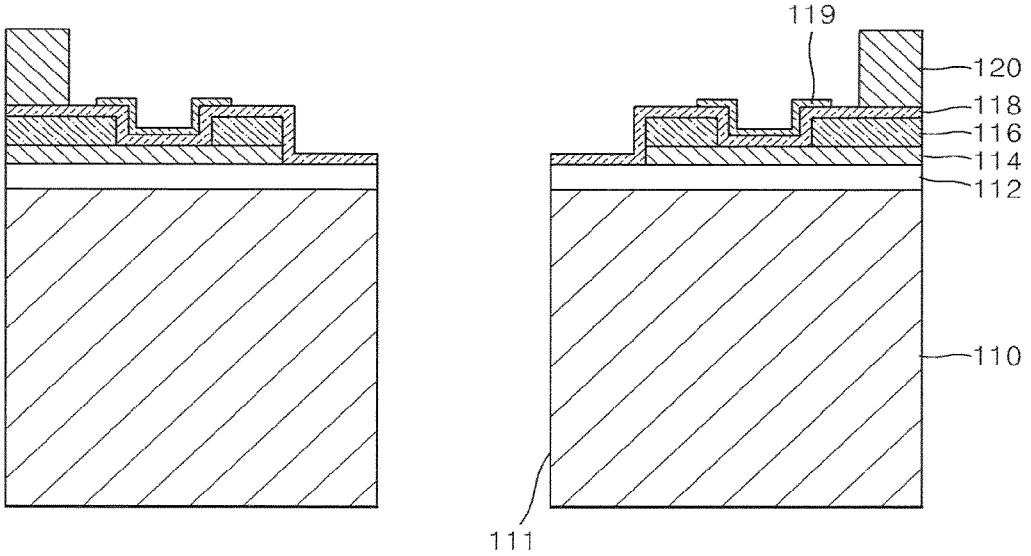

Referring to FIG. 18, the ink feed hole 111 for supplying ink may be formed in the substrate 110. The ink feed hole 111 may be formed by sequentially processing the passivation layer 118, the insulating layer 112 and the substrate 110. The ink feed hole 111 may be formed by dry etching, wet etching, or laser processing, however, other various methods may be used to form the ink feed hole 111. According to an embodiment, the ink feed hole 111 may be formed by penetrating the substrate 110 from the upper side of the substrate 110 to the lower side of the substrate 110.

As previously mentioned, forming of the ink feed hole 111 in the substrate 110 for supplying ink to the ink chamber 122 may be performed before forming of the chamber layer 120. Alternatively, the nozzle layer 130 may first be formed, and then the substrate 110 may be etched to penetrate the substrate 110 from the rear surface of the substrate 110, thereby forming the ink feed hole 111.

Figure 19:
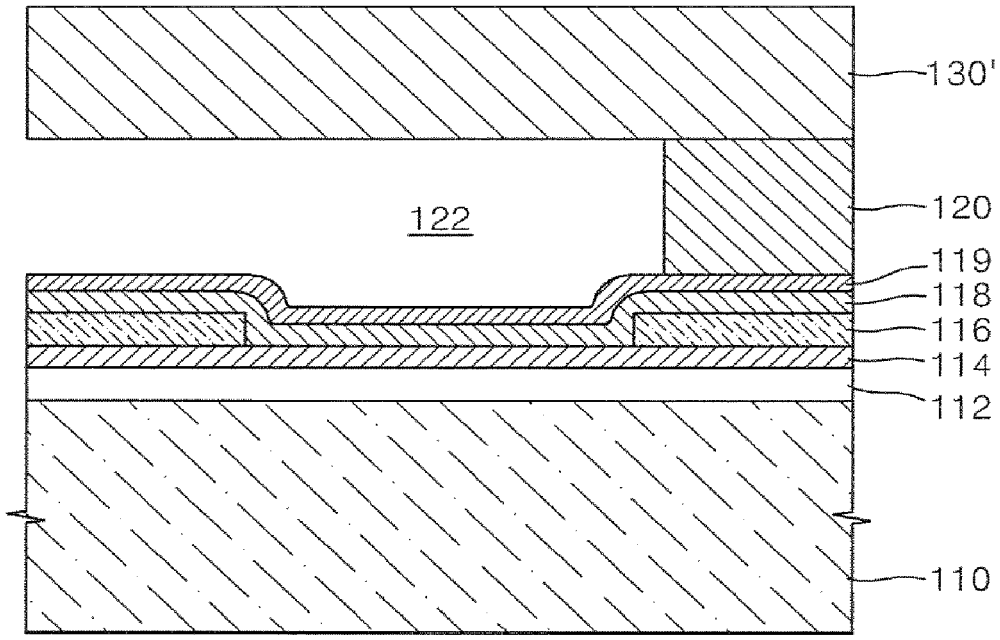

Referring to FIG. 19, a nozzle material layer 130' is formed on the chamber layer 120. The nozzle material layer 130' is formed of a photosensitive dry film including a light absorption material. The photosensitive dry film may be a negative type photosensitive polymer.

Figure 20:
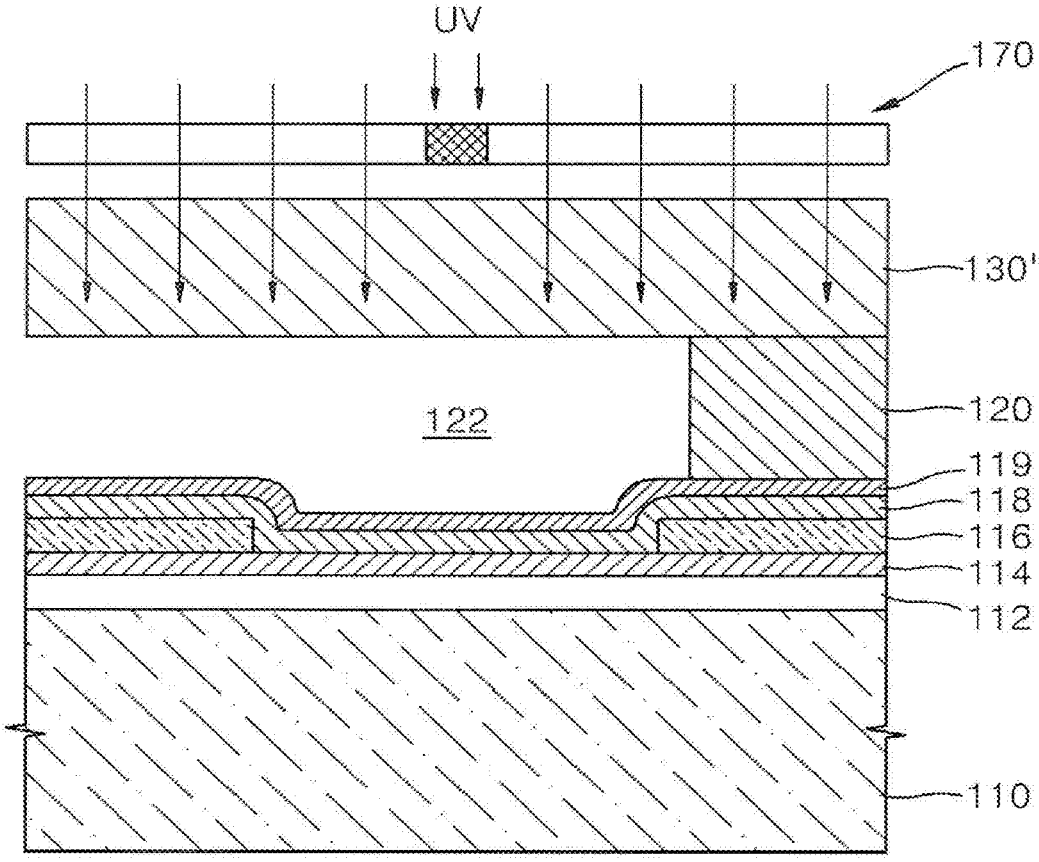

Referring to FIG. 20, the nozzle material layer 130' is exposed and developed using photolithography. More specifically, a photomask 170, on which a predetermined mask pattern is formed, is placed above the nozzle material layer 130', and then UV rays are irradiated to the photomask 170, thereby exposing the nozzle material layer 130'. Accordingly, a desired portion of the nozzle material layer 130' is exposed, and the non-exposed portion of the nozzle material layer 130' is removed using a developer in a process which will be described further later, thereby forming the nozzle 132. As further discussed below, when the nozzle material layer 130' formed on the chamber layer 120 includes the light absorption material, the nozzle 132 may be formed to have a uniform shape.

Figure 21:
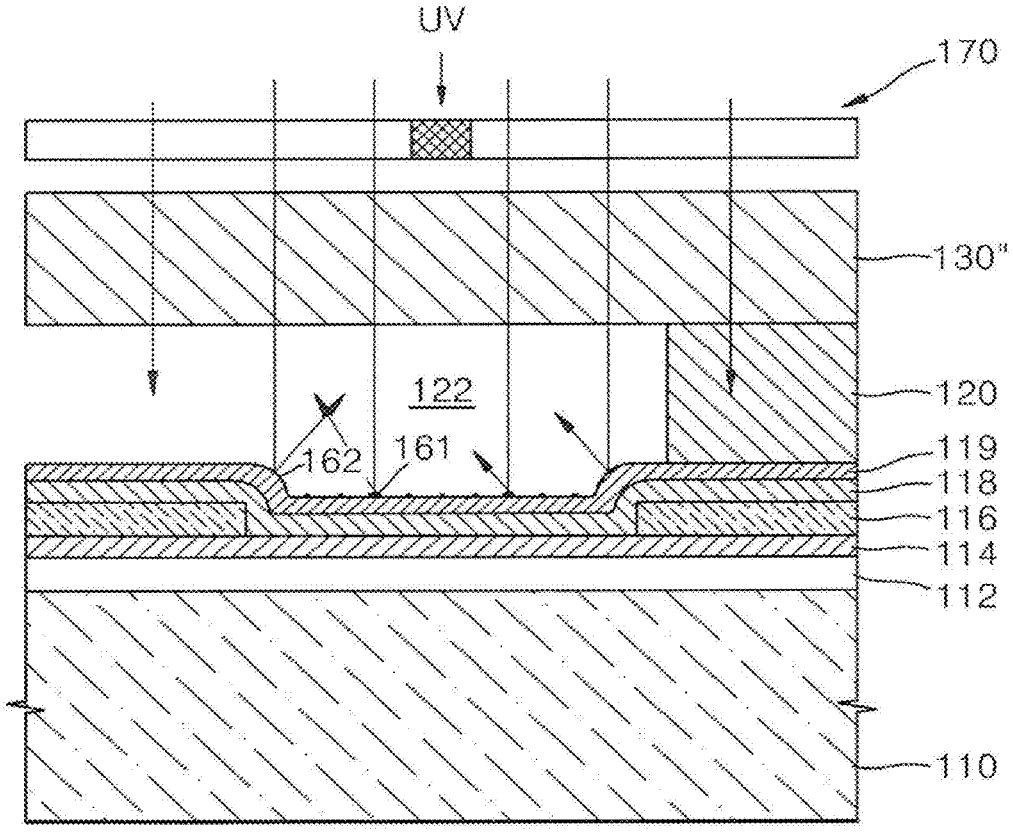
FIG. 21 is a cross-sectional view illustrative of exposure of a nozzle material layer that does not include the light absorption material.

FIG. 21 is a cross-sectional view of an inkjet printhead constructed similar to the inkjet printhead of FIG. 20, but the nozzle material layer 130" of which does not include a light absorption material, and illustrates the exposure of such nozzle material layer 130". Referring to FIG. 21, when the nozzle material layer 130" that does not include the light absorption material is exposed, the UV rays penetrating the nozzle material layer 130" cause, scattered reflection on the anti-cavitation layer 119. More specifically, during manufacturing of the inkjet printhead, when an electrode material formed on the heater 114 is patterned, a stepped portion at the ends of the electrode 116 may result. Accordingly, stepped portions 162 are generated on a region of the anti-cavitation layer 119 corresponding to the end parts of the electrode 116. In addition, in some cases, the electrode material may be formed by adding impurities, such as silicon or copper, to aluminum. When the electrode material is patterned to form the electrode 116, aluminum is removed by, e.g., wet etching. In this case, some of the impurity material, e.g., silicon, may not however be etched completely, and may remain on the heater 114. Then, since the passivation layer 118 and the anti-cavitation layer 119 are sequentially formed on the heater 114, projection parts or bumps 161 corresponding to the impurities that remained on the heater 114 may be formed on the upper surface of the anti-cavitation layer 119.

The projection parts 161 and/or the stepped portions 162 formed on the anti-cavitation layer 119 may cause scattered reflections of the UV rays penetrating the nozzle material layer 130" during the exposure off the anti-cavitation layer 119. Such scattered reflections of the UV rays may cause exposure of unintended portions of the nozzle material layer 130".

According to an aspect of the present disclosure, the nozzle material layer 130' may include light absorption material, which may advantageously reduce the scattered reflections. According to an embodiment, the light absorption material may absorb light having a wavelength that is substantially equal to that of the photoinitiator (photoacid generator), which is an organic component included in the material for the nozzle layer. The light absorption material may respond to the light before the photoinitiator does, and thus may absorb the light that had penetrated the nozzle material layer and that was scattered reflected from the anti-cavitation layer 119. Moreover, while the light absorption material absorbs the scattered reflected light, it does not participate in the crosslink as does the photoinitiator. Accordingly, the UV rays irradiated to expose the nozzle material layer 130' that are absorbed by the light absorption material of the nozzle material layer 130' do not participate in crosslink so that the desired portion of the nozzle material layer 130' may be exposed, making it possible to form uniform nozzle shapes. Accordingly, when the nozzle material layer 130' formed on the chamber layer 120 includes the light absorption material, the nozzle 132 may be formed to have a uniform shape.

According to embodiments of the present disclosure, the above described method may be employed to fabricate an inkjet printhead consistent with an aspect of the present disclosure, such as, for example, an embodiment shown in FIG. 11.

Several specific examples of manufacturing of the inkjet printhead ("Examples") are described below for the purpose of further illustrating aspects of the present disclosure. It should be noted however that the manufacturing of the inkjet printhead according to the full scope contemplated by the present disclosure is not limited to these specific Examples.

Material Example 1

Photosensitive Polymer Composition 30 g of propylene glycol methyl ethyl acetate (PGMEA) (manufactured by Samchun Chemical Co.), 2 g of diglycidyl hexahydro phthalate (DGHP) (manufactured by Sigma-Aldrich), and 0.8 g of Cyracure 6974 (manufactured by Dow Chemical Co.) are mixed in a jar to produce a mixture solution. Then, 40 g of EPON SU-8 (manufactured by Hexion Speciality Co.) is added to the jar, and is mixed with the mixture solution in an impeller for about 24 hours, thereby producing the photosensitive polymer composition.

Material Example 2

Photosensitive Dry Film

A photosensitive polymer composition is produced as described in Material Example 1, except that 0.4 g of 2,4-diethylthioxanthone (Nippon Kayaku) is added to the mixture as a light absorption material. Then, so produced photosensitive polymer composition is coated on a Kapton® polyimide film to a thickness of about 15 μm by a stretching coating process using a #20 Meyer rod installed on an ACCU-LAB™ Auto-Draw III stretching coating device (available from Industry Tech of Oldsmar, Fla., U.S.A.). Next, the coated Kapton® film is dried in a mechanical convection oven for about 15 minutes at 100° C., thereby producing the photosensitive dry film.

Material Example 3

Photosensitive Dry Film

A photosensitive dry film is produced as described in Manufacturing Example 2, except that the photosensitive polymer composition according to Material Example 1 is instead used.

Example 1

Fabrication of Printhead

An insulating layer 112 formed of a silicon oxide having a thickness of 2 μm, a heater 114 formed of a tantalum nitride having a thickness of about 500 Å, an electrode 116 formed of an AlSiCu alloy (the amounts of Si and Cu are respectively below 1 weight %) having a thickness of about 500 Å, the passivation layer 118 formed of a silicon nitride having a thickness of about 3000 Å and an anti-cavitation layer 119 formed of tantalum having a thickness of about 3000 Å are formed on a 6-inch silicon wafer substrate 110 using general sputtering and photolithography processes (refer to FIG. 13).

Then, the photosensitive polymer composition of Material Example 1 is spin coated for about 40 seconds at a speed of 2000 rpm, and is baked for about 7 minutes at 95° C., thereby forming the chamber material layer 120' having a thickness of about 10 μm (refer to FIG. 15). Then, as illustrated in FIG. 16, the chamber material layer 120' is exposed to i-lined UV rays using a photomask, on which a predetermined ink chamber and restrictor patterns are formed. The exposure amount is adjusted to 130 mJ/cm$^2$. The wafer (chamber material layer 120') is baked for about 3 minutes at 95° C., and is immersed in a PGMEA developer for about 1 minute so as to be developed. Then, the developed wafer (chamber material layer 120') is rinsed using isopropanol for about 20 seconds, thereby completing manufacture of the chamber layer 120 (refer to FIG. 17).

Then, as illustrated in FIG. 18, the passivation layer 118, the insulating layer 112, and the silicon wafer 110 are sequentially plasma etched from the upper side of the substrate 110 to the lower side of the substrate 110, thereby forming the ink feed hole 111. Power of the plasma etching device is set at 2000 Watt, an etching gas is a mixture of $SF_6$ and $O_2$ (mixture volume ratio of 10:1). The speed of silicon etching is 3.7 μm/min.

Next, the nozzle layer 130 is formed under the same conditions for forming of the chamber layer 120, except that the nozzle material layer 130' is formed on the entire surface of the chamber layer 120 using the photosensitive dry film of Material Example 2, and that the exposure amount is adjusted to 1300 mJ/cm$^2$ (refer to FIGS. 19 and 20).

Figure 22A:
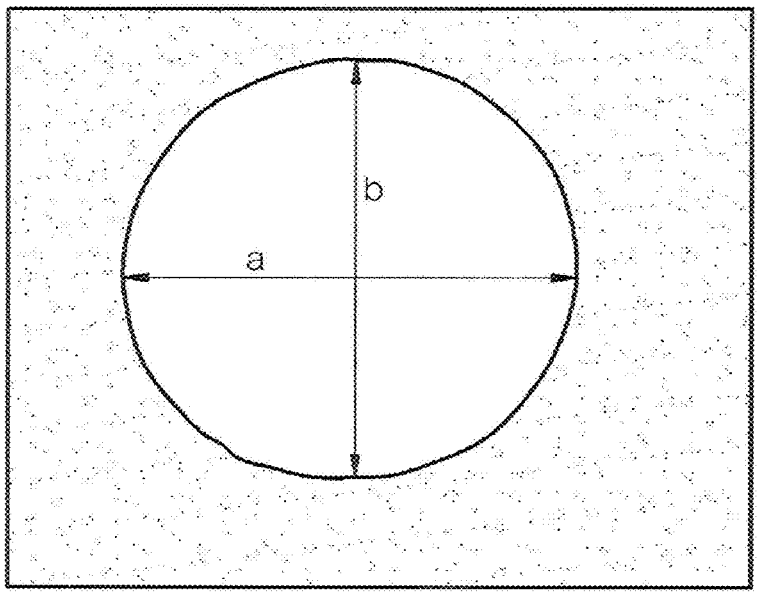
FIGS. 22A and 22B are schematic diagrams respectively of a plan view and a side cross-sectional view of a nozzle in an inkjet printhead manufactured according to Example 1.
Figure 22B:
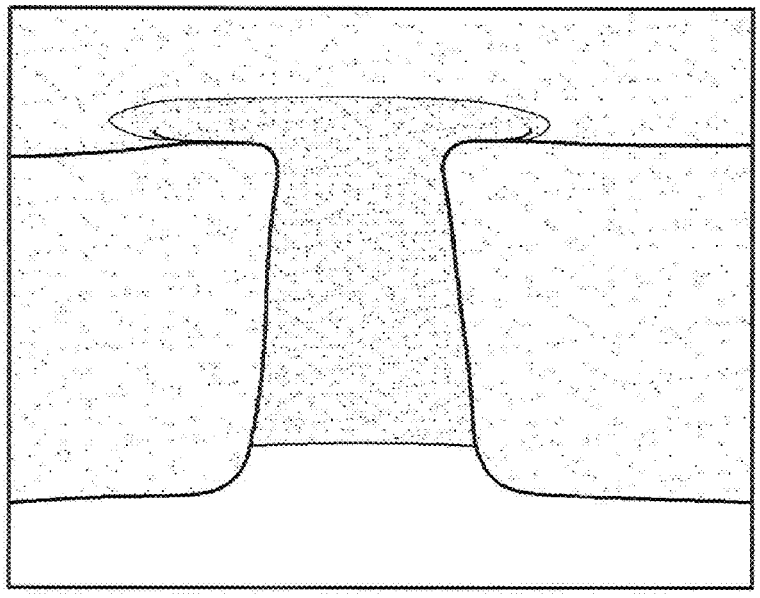

Accordingly, the inkjet printhead such as, e.g., one shown in FIG. 11, is manufactured. FIGS. 22A and 22B are schematic diagrams respectively of the top plan view and side cross-sectional view of the nozzle 132 of the inkjet printhead fabricated according to the Example 1.

Comparative Example 1

Fabrication of Printhead

Figure 23A:
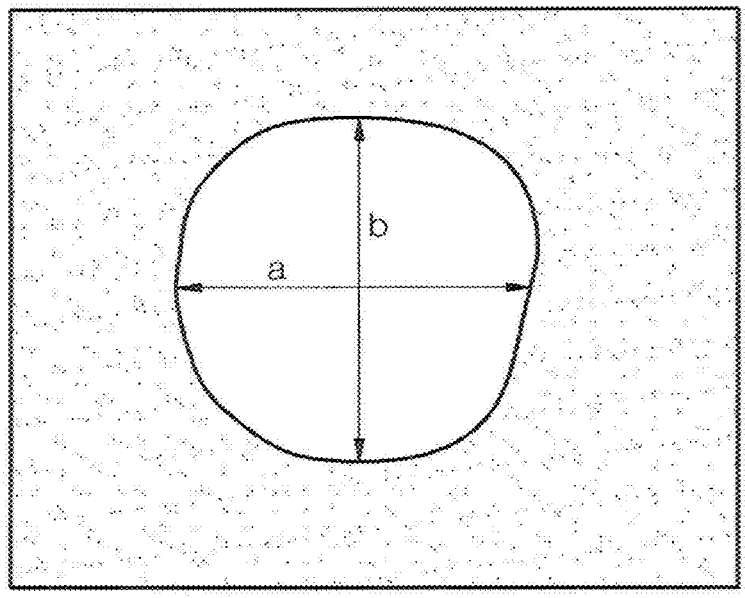
FIGS. 23A and 23B are schematic diagrams respectively of a plan view and a side cross-sectional view of a nozzle in an inkjet printhead manufactured according to Comparative Example 1.
Figure 23B:
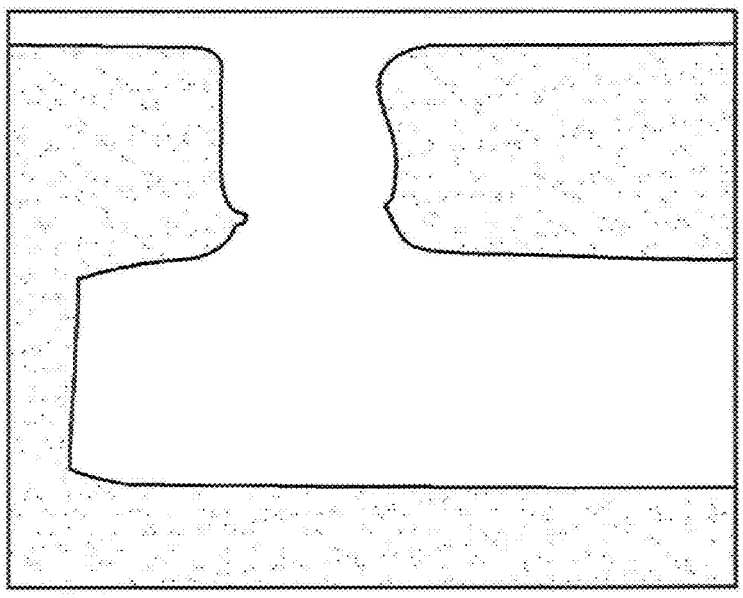

An inkjet printhead is manufactured as described in Example 1 above, except that the photosensitive dry film of Material Example 3 is used in the nozzle material layer 130'. FIGS. 23A and 23B are schematic diagrams respectively of the top plan view and side cross-sectional view of the nozzle 132 of the inkjet printhead fabricated according to the Comparative Example 1.

Referring to FIGS. 22A and 22B, in the inkjet printhead according to an embodiment of the present disclosure, the nozzle layer 130 includes the light absorption material so that the light absorption material responds to light before the photoinitiator during exposing of the nozzle material layer 130' for forming the nozzle layer, and thus absorbs the light that had penetrates the nozzle material layer 130' and that is scattered reflected back. However, the light absorption material only absorbs the scattered reflected light, and does not participate in crosslink as in the photoinitiator. Accordingly, only a desired portion of the nozzle material layer 130' may become exposed so that a uniform circular nozzle having the horizontal diameter (a) substantially equal to the vertical diameter (b) is formed, and a lower cross-section of the nozzle layer 130 is also well defined.

However, referring to FIGS. 23A and 23B, when the nozzle layer does not include the light absorption material, the UV rays penetrating the nozzle material layer 130" during exposure of the nozzle material layer 130" are scattered reflected on the anti-cavitation layer 119. As a result, cross-link is generated in a non-desired portion of the nozzle material layer 130' so that a non-uniform nozzle having the horizontal diameter (a) substantially different from the vertical diameter (b) is formed, and the lower cross-section of the nozzle layer 130 is not as well defined.

While the disclosure has been particularly shown and described with reference to several embodiments thereof, it will be understood by those of ordinary skill in the art that various changes in form and details may be made therein without departing from the spirit and scope of the disclosure as defined by the following claims.

What is claimed is:

1. An inkjet printhead, comprising:

a substrate;

a chamber layer formed on the substrate, the chamber layer defining therein an ink chamber; and a nozzle layer formed on the chamber layer, the nozzle layer having formed therein a nozzle in fluid communication with the ink chamber, wherein the nozzle layer is formed of a cured product of a photosensitive dry film comprising a light absorption material;

wherein the photosensitive dry film comprises a prepolymer, 1 to 10 parts by weiqht, based on 100 parts by weight of the prepolymer, of a photoinitiator, 0.03 to 5 parts by weight, based on 100 parts by weight of the prepolymer, of the light absorption material, wherein the light absorption material is one that does not participate in the crosslinkinq reaction of the prepolymer.

2. The inkjet printhead of claim 1, wherein the light absorption material comprises at least one compound selected from a benzophenone compound, a salicylic acid compound, a phenyl acrylate compound, a benzotriazole compound, an azo dye, a coumarine compound, a thioxanthone compound, a stilbene compound and a naphthalic acid compound.

3. The inkjet printhead of claim 1, wherein the chamber layer is formed of one of a cured product of a photosensitive polymer composition and a cured product of a photosensitive dry film.

4. The inkjet printhead of claim 1, wherein the substrate having formed therein an ink feed hole in fluid communication with the ink chamber.

5. The inkjet printhead of claim 1, further comprising:

an insulating layer formed on the substrate;

a heater and an electrode sequentially formed on the insulating layer; and a passivation layer formed to cover the heater and the electrode.

6. The inkjet printhead of claim 5, further comprising an anti-cavitation layer formed on the passivation layer.

7. The inkjet printhead of claim 1, further comprising a glue layer interposed between the substrate and the chamber layer.

* * * * *